US008286299B2

(12) United States Patent
Williams et al.

(10) Patent No.: US 8,286,299 B2
(45) Date of Patent: Oct. 16, 2012

(54) HANDHELD CANISTER VACUUM CLEANER

(76) Inventors: Danny Patrick Williams, Temecula, CA (US); Susan Marie Williams, Temecula, CA (US)

( * ) Notice: Subject to any disclaimer, the term of this patent is extended or adjusted under 35 U.S.C. 154(b) by 721 days.

(21) Appl. No.: 12/460,844

(22) Filed: Jul. 24, 2009

(65) Prior Publication Data

US 2010/0186188 A1 Jul. 29, 2010

Related U.S. Application Data

(60) Provisional application No. 61/147,285, filed on Jan. 26, 2009.

(51) Int. Cl.
*A47L 5/36* (2006.01)

(52) U.S. Cl. ..... 15/300.1; 15/327.5; 15/344

(58) Field of Classification Search ..... 15/327.5, 15/344, 300.1; *A47L 5/36*
See application file for complete search history.

(56) References Cited

U.S. PATENT DOCUMENTS 4,748,712 A * 6/1988 DiGiovanni ..... 15/327.5
5,440,809 A 8/1995 Padilla
6,049,941 A 4/2000 Vollenweider, II
6,159,085 A 12/2000 Hara
6,431,040 B1 8/2002 Miller et al.
2003/0220060 A1 11/2003 Bures
2004/0248507 A1 12/2004 Brazell et al.
2007/0119016 A1 5/2007 Drevitson
2007/0251198 A1 11/2007 Witter

* cited by examiner

*Primary Examiner* — David Redding
(74) *Attorney, Agent, or Firm* — Loyal McKinley Hanson

(57) ABSTRACT

A handheld canister vacuum cleaner device includes a canister assembly with a canister having a hollow interior and a suction-producing subassembly mounted on the canister that sucks air from the hollow interior. An attachment-coupling component is provided on the canister that serves to hold a vacuuming attachment on the canister while coupling the vacuuming attachment in fluid communication with the hollow interior of the canister. The attachment-coupling component holds the vacuuming attachment pivotally so that a user can pivot the vacuuming attachment relative to the canister to multiple user-selected angles for operating convenience. Preferably, the attachment-coupling component includes a ball-and-socket arrangement that includes a ball-shaped portion of the attachment-coupling component held pivotally by a socket-shaped component on the canister so that the user can pivot the attachment-coupling component to and lock it in place at a desired one of multiple pivotal positions.

9 Claims, 4 Drawing Sheets

HANDHELD CANISTER VACUUM CLEANER

CROSS REFERENCE TO RELATED APPLICATION

This application claims the benefit of U.S. Provisional Patent Application Ser. No. 61/147,285 that was filed on Jan. 26, 2009 by the same inventors as the present non-provisional patent application.

BACKGROUND OF THE INVENTION

1. Technical Field

This invention relates generally to the field of vacuum cleaner and air blower devices, and more particularly to a handheld canister vacuum device suited for multiple uses at work and home.

2. Description of Related Art

Manufacturers, suppliers, and users of vacuum cleaner devices sometimes refer to vacuum cleaners simply as "vacuums." One commonly-used type of vacuum, called a "canister vacuum," includes a canister supporting a motorized subassembly that produces suction by removing air from the canister. A flexible hose connects a handheld wand to an input port on the canister so that the suction is coupled to the head of the wand for vacuuming purposes.

In operation, a user places the head of the wand near debris to be vacuumed. Air sucked into the head moves through the wand, the hose, and the input port into the canister, carrying the debris along with it. The debris is then deposited in the canister, with the air passing out of an output port on the motorized subassembly. In some cases, a bag is attached to the output port of the motorized subassembly to help collect residual airborne dust that is not collected within the canister.

Compared to some traditional upright household vacuum cleaners, the hose-wand-and-canister combination of the canister vacuum advantageously enables the user to vacuum debris from otherwise difficult-to-access locations. In addition, the user can readily convert the canister vacuum to use as a blower device by connecting the hose to the output port instead of to the input port. Moreover, the input port of a canister vacuum can be connected by hose or other conduit to various shop locations, thereby enabling the canister vacuum to function somewhat remotely.

Despite the foregoing conveniences, some problems nevertheless arise. One problem, for example, results from the user holding or dragging a typical existing canister vacuum with one hand while manipulating the hose and wand with the other hand. It is a two-handed effort and it can be particular inconvenient in close quarters. If the user needs to move a chair or other item while using the canister vacuum, the user must first release the canister and/or wand, move the item, and then pick the canister and wand back up. In the case of larger canister vacuums, the user often pulls the canister throughout the house by means of the hose, with the hose getting entangled and the canister bumping into furniture, marring paint on the walls, damage cabinets, and so forth. Existing canister vacuums are generally big, bulky, and hard to store. Smaller units lack suction power. Thus, vacuum users need a way to alleviate the above drawbacks.

SUMMARY OF THE INVENTION

It is a primary object of the present invention to respond to the above-stated need and alleviate the foregoing concerns. The present invention does so predicated on the inventors' conception of a lightweight canister vacuum having a pivoting attachment-coupling component instead of a hose, providing what may be called a "handheld canister vacuum with articulating attachment-coupling component." It includes a small lightweight canister vacuum assembly with a unique swivel nozzle component on the canister (i.e., a pivoting attachment-coupling component) that a user can pivot relative to the canister to a desired one of multiple positions. With a vacuuming wand or other vacuuming attachment connected to the attachment-coupling component, the user holds the canister vacuum assembly in one hand, by a handle provided for that purpose, pivots the vacuuming wand and attachment-coupling component to a desired wand position relative to the canister, and proceeds to vacuum up debris while changing wand position whenever desired.

The pivoting vacuuming wand adjusts for user height and a desired vacuuming angle, thereby facilitating vacuuming under a couch or in some other difficult-to-access location. One-hand operation frees the other hand for moving objects out of the way while vacuuming. The absence of vacuum-assembly bulk and wand-connecting hoses reduces the likelihood of hose entanglement, marring of paint on the walls, and damage to furniture. The relatively small lightweight size contributes to ease of operation by users, especially people of limited strength. And, removal of the suction-producing subassembly on the canister along with connection of the vacuuming wand (or other blower attachment) to the output port of that subassembly quickly converts the device to use as a powerful but lightweight air blower.

To paraphrase some of the more precise language appearing in the appended claims and further introduce the nomenclature used, a vacuum cleaner device constructed according to the invention includes ( i) a canister assembly with a canister, (ii) a suction-producing subassembly on the canister, and (iii) an attachment-coupling component on the canister for coupling a vacuuming wand and/or other attachments to the canister. Those elements combine to form the vacuum cleaner device.

The canister defines a hollow interior of the canister. With the base of the canister set atop a horizontal support surface, the hollow interior extends from the base along a vertically disposed central axis to an upwardly opening end of the canister that is opposite the base. The suction-producing subassembly is mounted on the upwardly opening end of the canister where it serves the function of sucking air from the hollow interior of the canister in order to thereby produce a desired vacuum effect for vacuuming purposes.

According to the major aspect of the invention, the attachment-coupling component functions to hold a vacuuming wand or other user-selected vacuuming attachment on the canister pivotally. The attachment-coupling component has an input end and an output end and it defines a passageway that extends between the input end and the output end such that the input and output ends are in fluid communication with the hollow interior of the canister. The vacuuming attachment connects to the input end, with the attachment-coupling component holding the vacuuming attachment pivotally so that a user can pivot the vacuuming attachment to a user-selected angle relative to the canister.

Considering the vacuuming wand, for example, it is an elongated conduit through which air flows from an area being vacuumed to the hollow interior of the container (carrying debris along with it). It has a proximal end, a distal end, an axis of elongation and suitable material characteristics so that it can be held cantilever beam style by its proximal end. The attachment-coupling component holds the vacuuming wand on the canister by its proximal end while coupling the proximal end in fluid communication with the hollow interior of the canister. It does so in a way enabling a user to pivot the attachment-coupling component and the vacuuming wand together to a desired angle between the axis of elongation of the vacuuming wand and a plane containing the central axis of the canister. This achieves more ergonomic movement designed to minimize user movement and discomfort.

The attachment-coupling component holds the vacuuming attachment pivotally because it is itself held on the canister pivotally by a coupler-holding component on the canister. The coupler-holding component may be a portion of a side-wall of the canister that is integrally formed in unitary one-piece molded construction with the canister, for example, or it may be a separate component attached to the canister, for another example. The coupler-holding component functions as means for holding the attachment-coupling component on the canister pivotally (e.g., for pivotal movement about a horizontal pivotal axis).

Preferably, the attachment-coupling component includes a ball-shaped portion and the coupler-holding component includes a mating socket component (e.g., a mating socket portion of the canister) that cooperates with the ball-shaped portion of the attachment-coupling component to form a ball-and-socket coupler arrangement. The mating socket holds the ball-shaped portion pivotally. Connecting the proximal end of the vacuuming wand to the input end of the attachment-coupling component couples the vacuuming wand in fluid communication with the hollow interior of the canister. The user pivots the attachment-coupling component together with the vacuuming wand about a horizontally disposed pivotal axis to adjust the vacuuming wand upwardly and downwardly relative to the canister.

Other attachment-coupling components may be used to enable pivotal movement of the vacuuming attachment relative to the canister within the broader inventive concepts disclosed. An attachment-coupling component having a cylindrically shaped portion instead of a ball-shaped portion may be use, for example, with the cylindrically shaped portion being held on the canister by a mating cylindrically shaped coupler-holding component on or portion of the canister. In any case, the coupler-holding component also preferably includes means for locking the pivotally held attachment-coupling component in a user-selected one of multiple pivotal positions.

Thus, the invention provides a vacuum cleaner device with articulating attachment-coupling component that alleviates the concerns outlined above. The device performs a variety of tasks around a woodworking shop, construction site, or hobbyist's garage as well as in and around the home. The attachment-coupling component is a swivel nozzle that holds vacuuming attachments pivotally so that attachment position is variable relative to the canister. It attaches directly to the output ports of most woodworking shop tools to remove sawdust as it is produced and collecting fine dust particles before they become airborne, thereby helping achieve a dust-free work area. The device is compact, lightweight, and portable so that it is easily shuttled between job sites, or between home and work, occupying minimal storage space. It vacuums in a fully upright position without a connecting hose. The swivel nozzle pivots up and down so that the user can vacuum high and low and anywhere in between. With multiple uses for indoor and outdoor blower use, it is also handy for inflating and fully deflating air mattresses. The following illustrative drawings and detailed description make the foregoing and other objects, features, and advantages of the invention more apparent.

DESCRIPTION OF THE PREFERRED EMBODIMENTS

Figure 1:
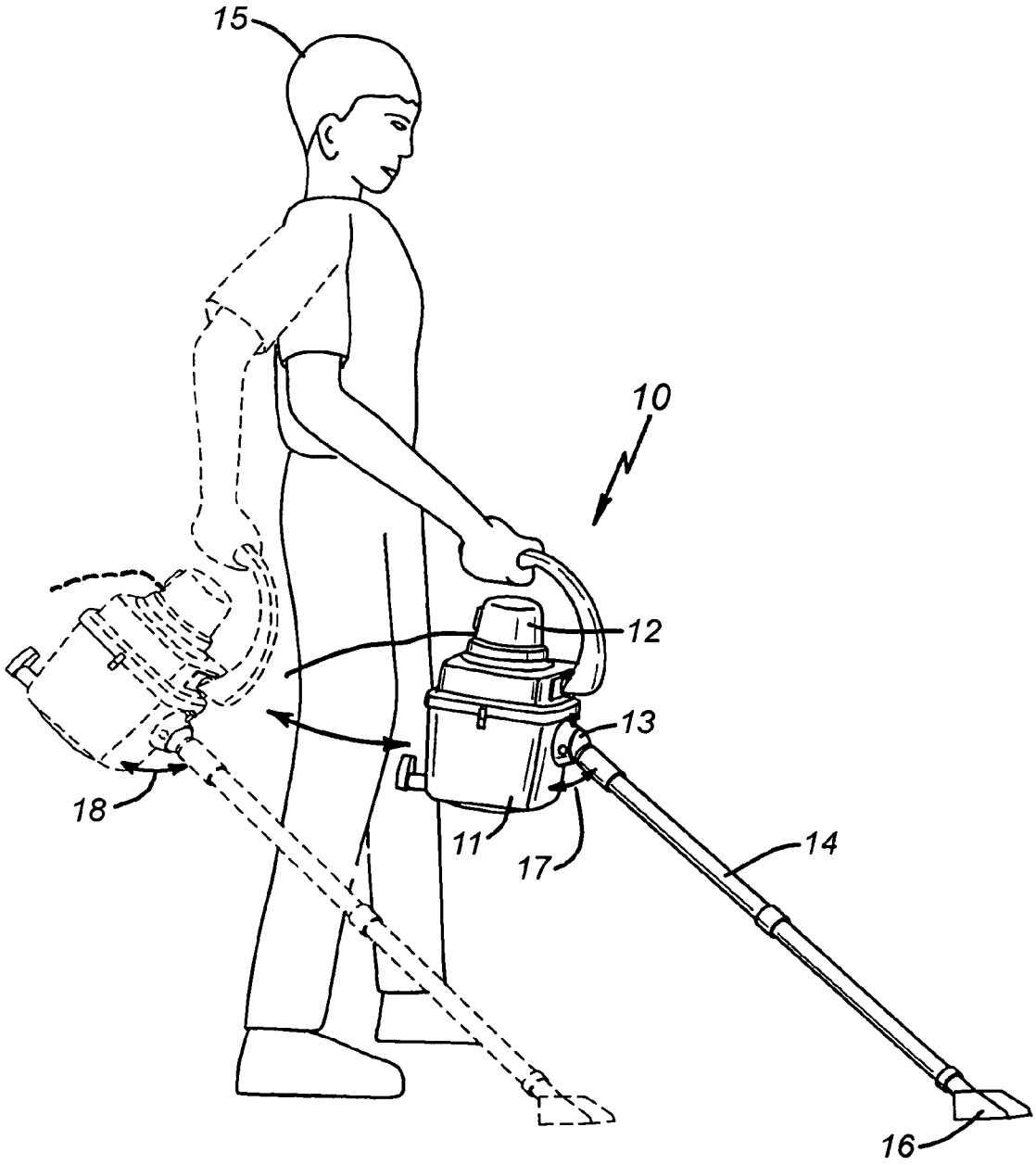
FIG. 1 of the drawings is a perspective view of a user vacuuming debris with a vacuum cleaner device constructed according to the present invention.

FIG. 1 of the drawings shows a vacuum cleaner device 10 constructed according to the invention. Generally, the device 10 includes a canister assembly having a canister 11 on which is mounted a suction-producing subassembly 12. Those two elements operate in a known way as a canister vacuum cleaner. The device 10 also includes an attachment-coupling component 13 on the canister 11 that holds a vacuuming wand 14 or other user-held vacuuming attachment on the canister 11. As a user 15 positions a vacuuming head 16 on a distal end of the vacuuming wand 14 next to debris to be vacuumed, the combination of air and debris travels into the vacuuming head 16, through the vacuuming wand 14, through the attachment-coupling component 13, and into the canister 11. As the user 15 moves the canister 11 to the position shown in phantom lines in FIG. 1, the attachment-coupling component 13 and the vacuuming wand 14 pivot together relative to the canister 11, from an acute angle 17 in FIG. 1, for example, to a ninety-degree angle 18 as shown in phantom lines.

Figure 2:
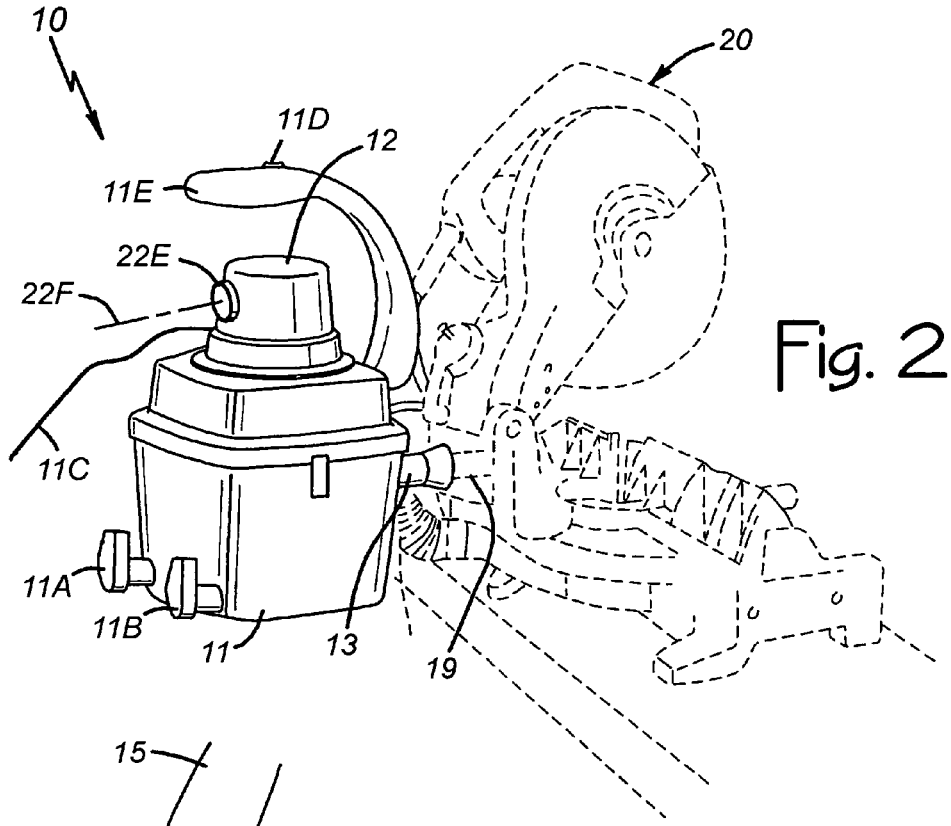
FIG. 2 of the drawings is a perspective view of the vacuum cleaner device shown connected to a power saw dust output port.

FIG. 2 of the drawings illustrates typical shop use of the vacuum cleaner device 10 in cleaning up dust, with the attachment-coupling component 13 of the device 10 connected to a dust output port 19 of typical woodworking power tool 20 (e.g., a table saw). The tool 20 is illustrated in phantom lines in FIG. 2. With the device 10 so connected, the user turns on power to the device 10 and the tool 20, and then the user operates the tool 20 in a normal manner. Dust produced by operation of the tool 20 is sucked from the dust output port 19 into the device 10, thereby significantly decreasing the amount of airborne dust that would otherwise occur when the tool 20 is in operation. FIG. 2 also shows two cord wrap hooks 11A and 11B on the canister 11 for use in storing an electric power cord 11C for storage or transportation. In operation, however, the electric power cord 11C is removed from the cord wrap hooks 11A and 11B and connected to an electric power source in order to power the suction-producing subassembly 12. The user operates a switch 11D on a handle 11E of the device 10 in order to turn the suction-producing subassembly 12 ON and OFF.

After using the tool 20, the user disconnects the device 10 from the tool 20 and attaches a suitably short vacuuming attachment to the device 10 (e.g., a shorter version of the vacuuming wand 14 in FIG. 1). That outfits the device 10 for use as a lightweight and powerful dust collecting handheld vacuum suitable for cleaning the tool bench area. After vacuuming dust from the tool bench area, the user connects a blower attachment to the output port of the device 10 and blows any remaining dust from the work bench area to the work floor. The user then disconnects the blower attachment from the output port and attaches a longer vacuuming wand to the device 10 for use in vacuuming up the dust and debris from the work floor. As an alternative, the user detaches the suction-producing subassembly (i.e., the motor subassembly) from the canister of the device 10, attaches a blower wand to the output port on the suction-producing subassembly, and proceeds to blow debris that is spread all over the work area to a central location, thereafter vacuuming it up.

Figure 3:
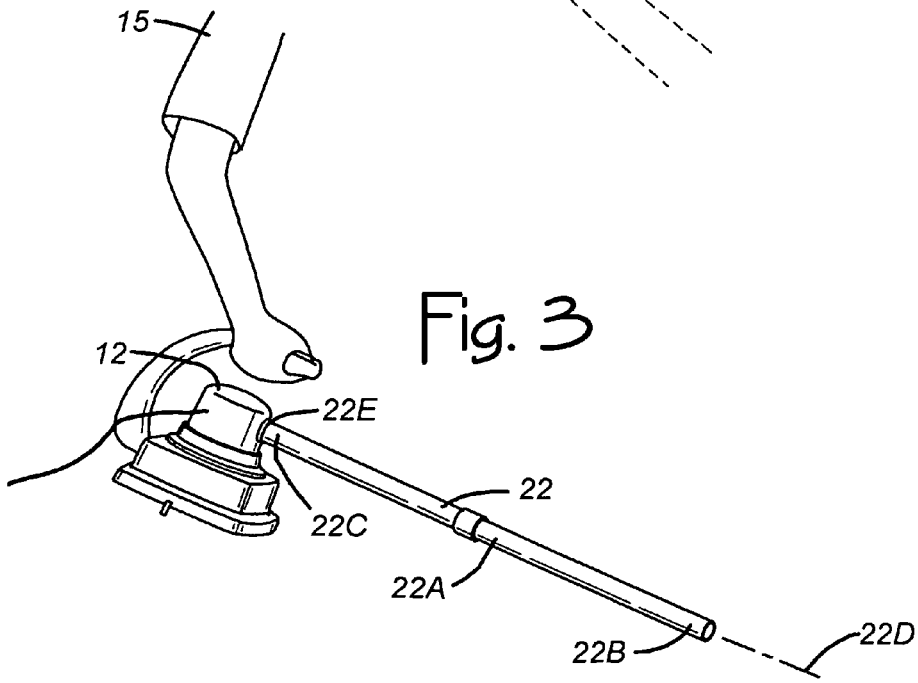
FIG. 3 is a perspective view of the vacuum cleaner device being used as a blower device, with an X-Y-Z Cartesian coordinate system included for convenience in describing various spatial relationships.

FIG. 3 illustrates the user 15 blowing debris using a blower wand 22 attached to an output port on the suction-producing subassembly 12. For purposes of describing the invention, the blower wand 22 illustration in FIG. 3 is intended to also represent the configuration of a vacuuming wand and other attachments, including the vacuuming wand 14 shown in FIG. 1. It includes a hollow tube 22A having a cylindrical proximal end 22B, a distal end 22C, and an axis of elongation 22D. The proximal end 22B slides onto a cylindrical output port 22E (FIGS. 2 and 3) of the suction-producing subassembly 12, with the axis of elongation 22D of the hollow tube 22A coincident with an axis 22D (FIG. 2) on which the cylindrical output port 22E is centered. The suction-producing subassembly 12 is a known type of component, the illustrated version including a 10-Ampere motor that powers a 300 cubic-feet-per-minute blower mounted within a high-impact polypropylene housing. It sucks air from the canister 11 and expels it from the output port 22E in a known way.

The foregoing description suggests just a few of the multiple shop-related uses for the device 10. Further details of a vacuum cleaner device suitable for connection to the dust port of a power tool are provided in United States Patent Publication No. US 2009/0139048 A1 published on Jun. 4, 2009, which patent publication is a publication of U.S. patent application Ser. No. 12/077,568 filed on Mar. 20, 2008 as a continuation-in-part of U.S. patent application Ser. No. 11/998,490 filed on Nov. 30, 2007. That patent publication is hereby incorporated herein by reference for all the details it provides.

Figure 4:
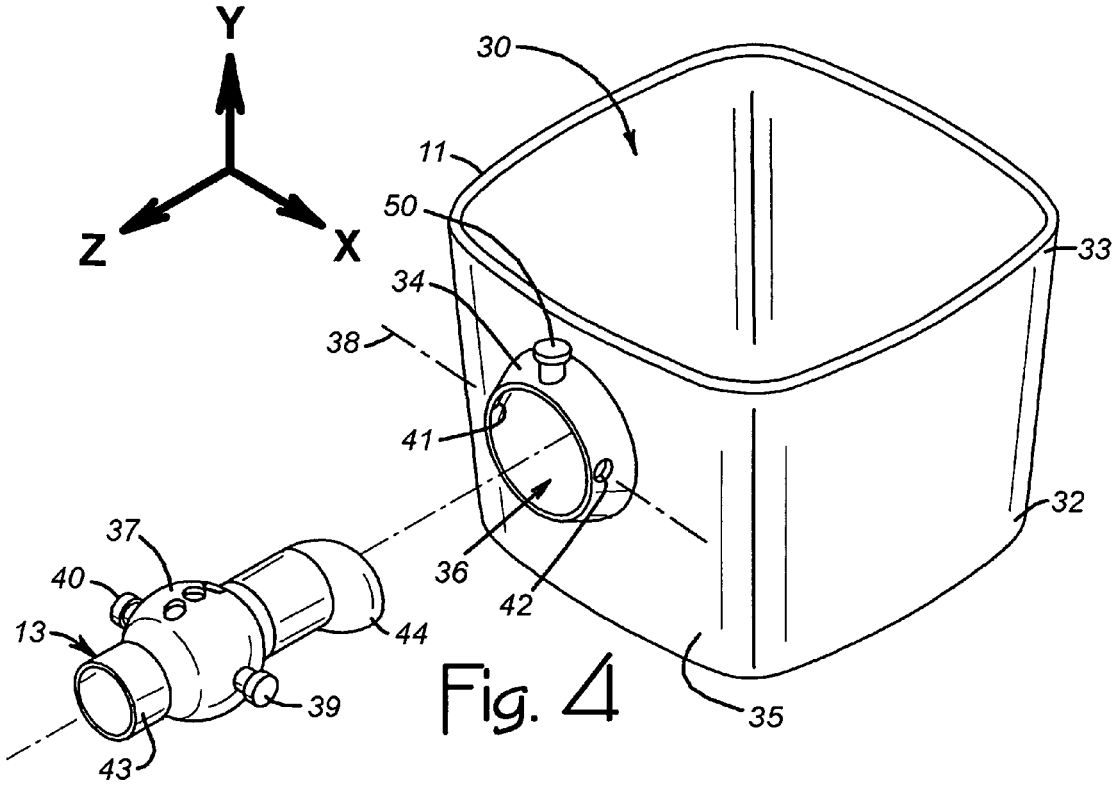
FIG. 4 is an exploded view of the attachment-coupling component on the canister showing the ball-shaped portion and the coupler-holding socket component on the canister.
Figure 5:
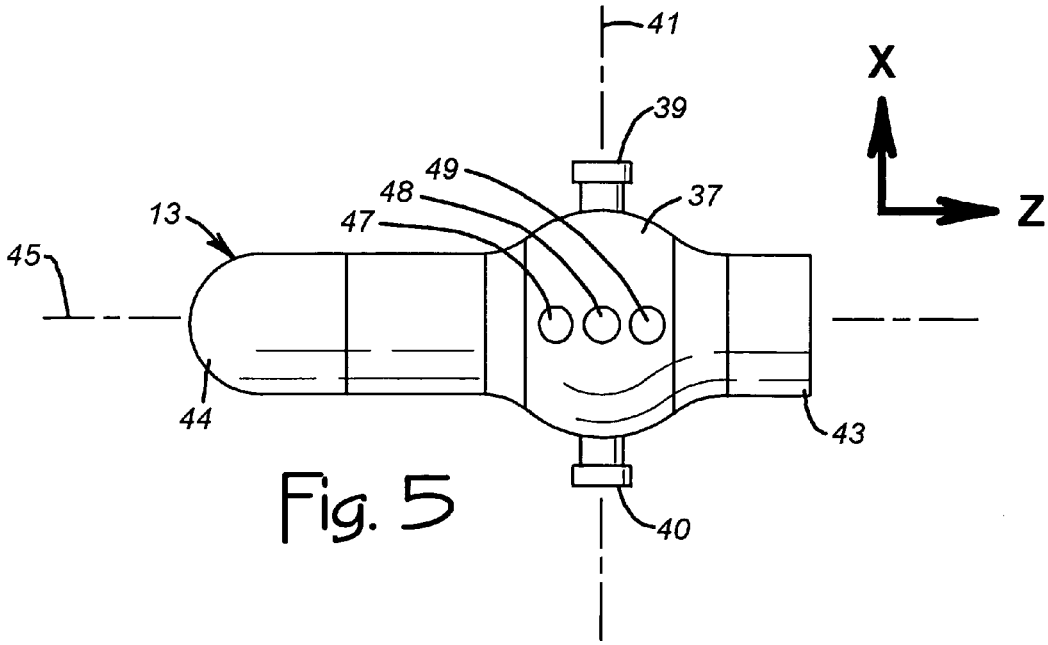
FIG. 5 is a further enlarged plan view of the attachment-coupling component.
Figure 6:
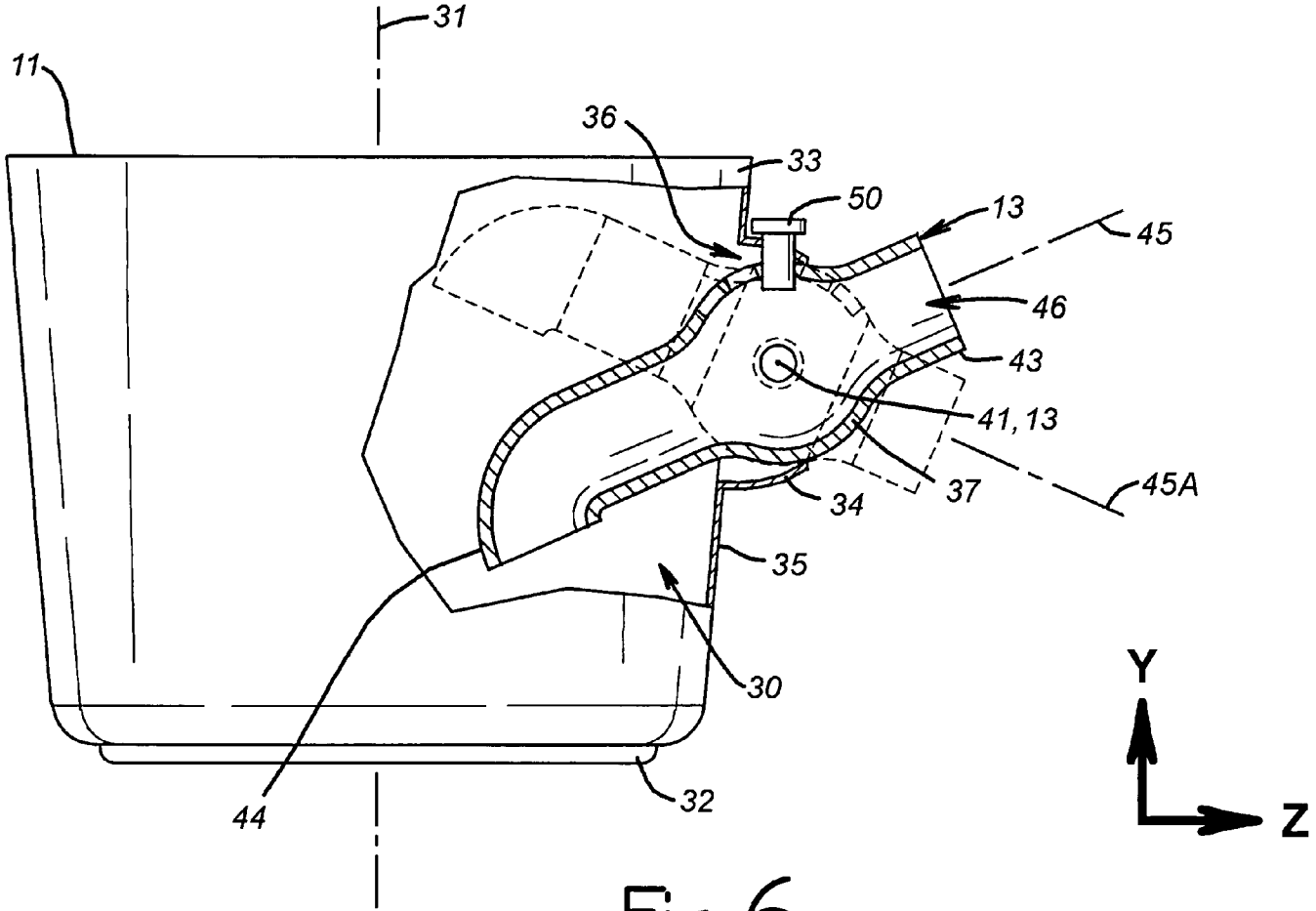
FIG. 6 is an elevation view of the canister with portions broken out to reveal the attachment-coupling component in cross section as view in a vertical bisecting plane containing the central axis of the canister.

Now consider FIGS. 4, 5, and 6. They show details of the canister 11 and the attachment-coupling component 13. The canister 11 is a container (e.g., a structure composed of high-impact polypropylene or other rigid material) and it defines a hollow interior 30 (FIGS. 4 and 6). The hollow interior 30 extends along a vertically disposed central axis 31 that is parallel to the Y axis of the Cartesian coordinate system in FIG. 6, from a closed base portion 32 of the canister 11 to an upwardly opening upper end portion 33 of the canister 11. As an idea of size, the overall height of the illustrated canister 11 is about 8.3 inches and it has about a one-gallon capacity.

The attachment-coupling component 13 is mounted on the canister 11 by a coupler-holding component 34. FIG. 4 is an exploded view that shows the attachment-coupling component 13 apart from the coupler-holding component 34, while FIG. 6 shows those two components assembled. The container includes a sidewall 35 that defines an input port 36 (FIGS. 4 and 6), with the illustrated coupler-holding component 34 being an outwardly protruding portion of the sidewall 35 that circumscribes the input port 36. The illustrated coupler-holding component 34 is molded with the rest of the canister 11 in unitary one-piece construction to have a shape that closely mates a ball-shaped potion 37 of the attachment-coupling component 13 while still allowing a user to pivot the ball-shaped potion 37 up and down about a horizontal pivot axis 38 shown in FIG. 4.

Axle members 39 and 40 protrude from the ball-shaped portion 37 of the attachment-coupling component 13 along an axis 41 (FIG. 5) so that when the component 13 is assembled within the component 34, the axle members 39 and 40 extend into axle-receiving holes 41 and 42 on the coupler-holding component 34 as means for mounting the attachment-coupling component 13 pivotally. So assembled, the axis 41 of the component 13 coincides with the axis 38 of the component 34. The axle members 39 and 40 may, for example, be threaded posts that a manufacturer or other assembler of the device 10 inserts through the axle-receiving holes 41 and 42 and screws into threaded holes in the ball-shaped portion 37 as part of the assembly procedure.

With further regard to the attachment-coupling component 13 (i.e., the swivel nozzle), it has an input end 43, an output end 44, and an axis of elongation 45 (FIGS. 5 and 6. It defines a fluid-communicating passageway 46 (FIG. 6) extending between the input and output ends 43 and 44. A user slides a proximal end of the vacuuming wand 14 or other vacuuming attachments onto the input end 43 (similar to the attachment of the blower wand 22 on the output port 22E), with an axis of elongation of the vacuuming wand or other vacuuming attachment then coincident with the axis of elongation 45 of the attachment-coupling component 13. Doing so couples the vacuuming wand or other vacuuming attachment in fluid communication with the hollow interior 30 of the canister 11. As a further idea of size, the illustrated attachment-coupling component 13 is about 7-12 inches in overall length measured along the axis of elongation 45, while the input end 43 is cylindrically shaped and centered on the axis of elongation 45 with an outside diameter of about 1.72 inches. Of course, those dimensions and the predetermined angular positions may vary significantly without departing from the inventive concepts disclosed.

Indentations 47, 48, and 49 in the ball-shaped portion 37 (FIG. 5) receive a spring-loaded locking pin 50 on the coupler-holding component 34 (FIGS. 4 and 6) in order to thereby lock the attachment-coupling 13 in a user-selected one of three predetermined positions (e.g., 60-degree, 90-degree, and 120-degree angles between the axis of elongation 45 and a plane containing the central axis 31 of the canister 11). A user moves the locking pin 50 outwardly parallel to the central axis 31 of the canister 11 for unlocking purposes and then releases the locking pin 50 with the result that a spring (not show) returns the locking pin 50 back into engagement of the attachment-coupling component 13.

Concerning the ball-shaped portion 37 of the attachment-coupling component 13, FIG. 6 is intended to illustrate both a ball-shaped portion and a barrel-shaped portion since both a ball-shaped portion and a barrel-shaped portion appear the same in cross section as viewed in a vertical bisecting plane through the component. Based upon the description herein, one of ordinary skill in the art can readily provide an attachment-coupling component having a barrel-shaped portion (i.e., a cylindrically shaped portion centered on the pivotal axis 41 in FIG. 5), together with a coupler-holding component on the canister that is adapted in size and shape to receive such a barrel-shaped portion.

Thus, the invention provides a vacuum cleaner device with articulating attachment-coupling component that alleviates existing concerns while providing additional advantages. Although exemplary embodiments have been shown and described, one of ordinary skill in the art may make many changes, modifications, and substitutions without necessarily departing from the spirit and scope of the invention. In addition to the barrel alternative mentioned above, for example, an attachment-coupling component having runners that mate with grooves in the coupler-holding component can be used (or vice-versa) to pivotally couple and attachment to the canister. As for the specific terminology used to describe the exemplary embodiments, it is not intended to limit the invention; each specific term is intended to include all technical equivalents that operate in a similar manner to accomplish a similar purpose or function.

What is claimed is:

1. A vacuum cleaner device, comprising:

a canister having a hollow interior;

suction-producing means on the canister for sucking air from the hollow interior; and an attachment-coupling component on the canister that serves as means for holding a vacuuming attachment on the canister pivotally while coupling the vacuuming attachment in fluid communication with the hollow interior of the canister, said attachment-coupling component being held on the canister pivotally to enable a user to pivot the vacuuming attachment relative to the canister;

said vacuum cleaner device further comprising a coupler-holding component on the canister that functions as means for holding the attachment-coupling component on the canister pivotally; and wherein the coupler-holding component includes means for locking the attachment-coupling component in a user-selected one of multiple pivotal positions.

2. A vacuum cleaner device as recited in claim 1, wherein the coupler-holding component is molded with the canister in one-piece construction.

3. A vacuum cleaner device as recited in claim 1, wherein the attachment-coupling component includes a ball-shaped portion, the coupler-holding component includes a mating socket portion, and the ball-shaped portion is held pivotally by the mating socket portion for pivotal movement about a pivotal axis.

4. A vacuum cleaner device, comprising:

a canister that defines a hollow interior of the canister extending along a central axis of the canister;

suction-producing means on the canister for sucking air from the hollow interior;

a vacuuming attachment, including an elongated hollow tube composed of a rigid material, said tube having a proximal end, a distal end, and an axis of elongation extending between the proximal and distal ends; and an attachment-coupling component on the canister that serves as means for holding the vacuuming attachment on the canister pivotally while coupling the vacuuming attachment in fluid communication with the hollow interior of the canister, said attachment-coupling component being held on the canister pivotally to enable a user to pivot the vacuuming attachment relative to the canister to a user-selected angle between the axis of elongation of the tube and the central axis of the canister;

said vacuum cleaner device further comprising a coupler-holding component on the canister that functions as means for holding the attachment-coupling component on the canister pivotally; and wherein the coupler-holding component includes means for locking the attachment-coupling component in a user-selected one of multiple pivotal positions.

5. A vacuum cleaner device as recited in claim 4, wherein the coupler-holding component is molded with the canister in one-piece construction.

6. A vacuum cleaner device as recited in claim 4, wherein the attachment-coupling component includes a ball-shaped portion, the coupler-holding component includes a mating socket portion, and the ball-shaped portion is held pivotally by the mating socket portion for pivotal movement about a pivotal axis.

7. A vacuum cleaner canister assembly, comprising:

a canister having a base, a sidewall, and an upwardly opening portion opposite the base, said canister defining a hollow interior of the canister that extends upwardly along a central axis of the canister from the base to the upwardly opening portion; and an attachment-coupling component on the canister that serves as means for holding a vacuuming attachment on the canister pivotally while coupling the vacuuming attachment in fluid communication with the hollow interior of the canister;

wherein the sidewall of the canister includes a coupler-holding portion for holding the attachment-coupling component pivotally, said coupler-holding portion defining an input opening;

wherein the attachment-coupling component has an input end for receiving an end of a vacuuming attachment and an output end, said attachment-coupling component defining a passageway that extends between the input end and the output end such that the input and output ends are in fluid communication; and wherein the attachment-coupling component extends through the input opening with the output end of the attachment-coupling component in fluid communication with hollow interior of the canister;

wherein the coupler-holding component includes means for locking the attachment-coupling component in a user-selected one of multiple pivotal positions.

8. A vacuum cleaner canister assembly as recited in claim 7, wherein the coupler-holding portion of the sidewall is molded with the canister in unitary one-piece construction.

9. A vacuum cleaner device as recited in claim 7, wherein the attachment-coupling component includes a ball-shaped portion, the coupler-holding component includes a mating socket portion, and the ball-shaped portion is held pivotally by the mating socket portion for pivotal movement about a pivotal axis.

* * * * *